US007246887B2

(12) United States Patent
O'Hara et al.

(10) Patent No.: US 7,246,887 B2
(45) Date of Patent: Jul. 24, 2007

(54) DUAL INPUT BI-DIRECTIONAL PRINTHEAD DRIVER INTEGRATED CIRCUIT

(75) Inventors: Shawn E. O'Hara, Rochester, NY (US); Robert P. Dutt, West Henrietta, NY (US); Denis P. Reilly, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 415 days.

(21) Appl. No.: 11/013,143

(22) Filed: Dec. 15, 2004

(65) Prior Publication Data

US 2005/0200661 A1 Sep. 15, 2005

Related U.S. Application Data

(60) Provisional application No. 60/531,920, filed on Dec. 23, 2003.

(51) Int. Cl.
*B41J 2/05* (2006.01)

(52) U.S. Cl. ..... 347/58; 347/59

(58) Field of Classification Search ..... 347/5, 347/9, 14, 61, 57–59
See application file for complete search history.

(56) References Cited

U.S. PATENT DOCUMENTS

| | | | | |
|---|---|---|---|---|
| 4,746,941 | A | 5/1988 | Pham et al. | 347/237 |
| 5,030,971 | A * | 7/1991 | Drake et al. | 347/57 |
| 5,126,759 | A | 6/1992 | Small et al. | 347/237 |
| 5,675,366 | A * | 10/1997 | Hayasaki et al. | 347/58 |
| 2002/0154321 | A1 | 10/2002 | Pham et al. | 358/1.8 |

* cited by examiner

*Primary Examiner*—Juanita D. Stephens
(74) *Attorney, Agent, or Firm*—Lawrence P. Kessler

(57) ABSTRACT

A driver IC (60) for a printhead includes a first set of data side input/output pads (62) and a second set of data side input/output pads (63). The driver IC further includes circuitry (100) that can select that data is to be input at the first set of pads and output at the second set of pads.

19 Claims, 4 Drawing Sheets

DUAL INPUT BI-DIRECTIONAL PRINTHEAD DRIVER INTEGRATED CIRCUIT

CROSS REFERENCE TO RELATED APPLICATION

Reference is made to and priority claimed from U.S. Provisional Application Ser. No. 60/531,920, filed Dec. 23, 2003, entitled DUAL INPUT BI-DIRECTIONAL PRINTHEAD DRIVER INTEGRATED CIRCUIT.

FIELD OF THE INVENTION

The present invention is directed to electronic digital printing devices. More particularly, one embodiment of the present invention is directed to a dual input bi-directional printhead driver integrated circuit.

BACKGROUND OF THE INVENTION

Many electronic digital printers apply print characters to paper via multiple exposure elements of an exposure device. In some printers, such as the NexPress 2100 from NexPress Solutions LLC, the exposure elements are light emitting diodes ("LEDs") and the exposure device is an LED printhead.

The LEDs are typically controlled by a printhead driver integrated circuit ("IC"). Each driver IC may control many LEDs, and a printer may include multiple driver ICs.

FIG. 1 is a block diagram of a prior art printhead driver IC board 10 that is used to control LEDs in a digital printer. Board 10 includes driver ICs 20 and 22 mounted on a substrate 12. Input/output pads 13 are placed along one of the long sides of the rectangular shaped driver ICs 20, 22 and are coupled to the LEDs (not shown). Pads 14 are placed along the other long side or "front" side of driver ICs 20, 22 and are coupled to a data bus. In order to connect pads 14 to the data bus, long parallel gold data traces 16 are required on substrate 12 to reach all driver ICs, and a very high number of wire bonds 15 are required to connect all the driver ICs to data traces 16. Host board connection pads 17 are also formed on substrate 12 to connect driver ICs 20, 22 to a host device that is the source of the data.

From the viewpoint of the host data board driver, the number of loads being driven by each data line on board 10 to the driver ICs is very high, since many driver ICs connect to the data traces in parallel and each data line has different signal path lengths. A transmission line analysis of printing systems that include board 10 shows complicated waveform reflections as a result of the uneven paths and unmatched lengths. This causes data speed limitations as well as excessive electromagnetic interference ("EMI") emissions.

The large number of wire bonds, as well as the long and unmatched in length signal paths on board 10 limit the speed of operation for high-speed data transmission. The parallel traces and the high number of wire bonds also add significant cost to the manufacturing materials and processes.

As the demand for higher speed operation of exposure devices such as LED printheads continues to rise, the need for higher speed transmission of data to the drivers also rises. Further, as the speed of transmission rises, EMI emissions also rise.

Based on the foregoing, there is a need for an improved printhead driver IC and data transfer method that allows for higher data transmission speed, with reduced EMI emissions.

SUMMARY OF THE INVENTION

The present invention is a driver IC for a printhead that includes a first set of data side input/output pads and a second set of data side input/output pads. The driver IC further includes circuitry that is adapted to selecting that data will be input at the first set of pads and output at the second set of pads. The driver IC may also include a third set of front input pads. The circuitry can select any of three inputs and select either of two outputs to achieve a desired direction of data flow—right to left or left to right.

The use of side data bussing allows for more efficient connection of multiple drivers and also helps accomplish an increased speed demand with lower EMI emissions.

DETAILED DESCRIPTION OF THE INVENTION

One embodiment of the present invention is a printhead driver IC that includes side data bussing and bi-directional data flow. The use of side data bussing allows for more efficient connection of multiple drivers and also helps accomplish an increased speed demand with lower EMI emissions.

Figure 1:
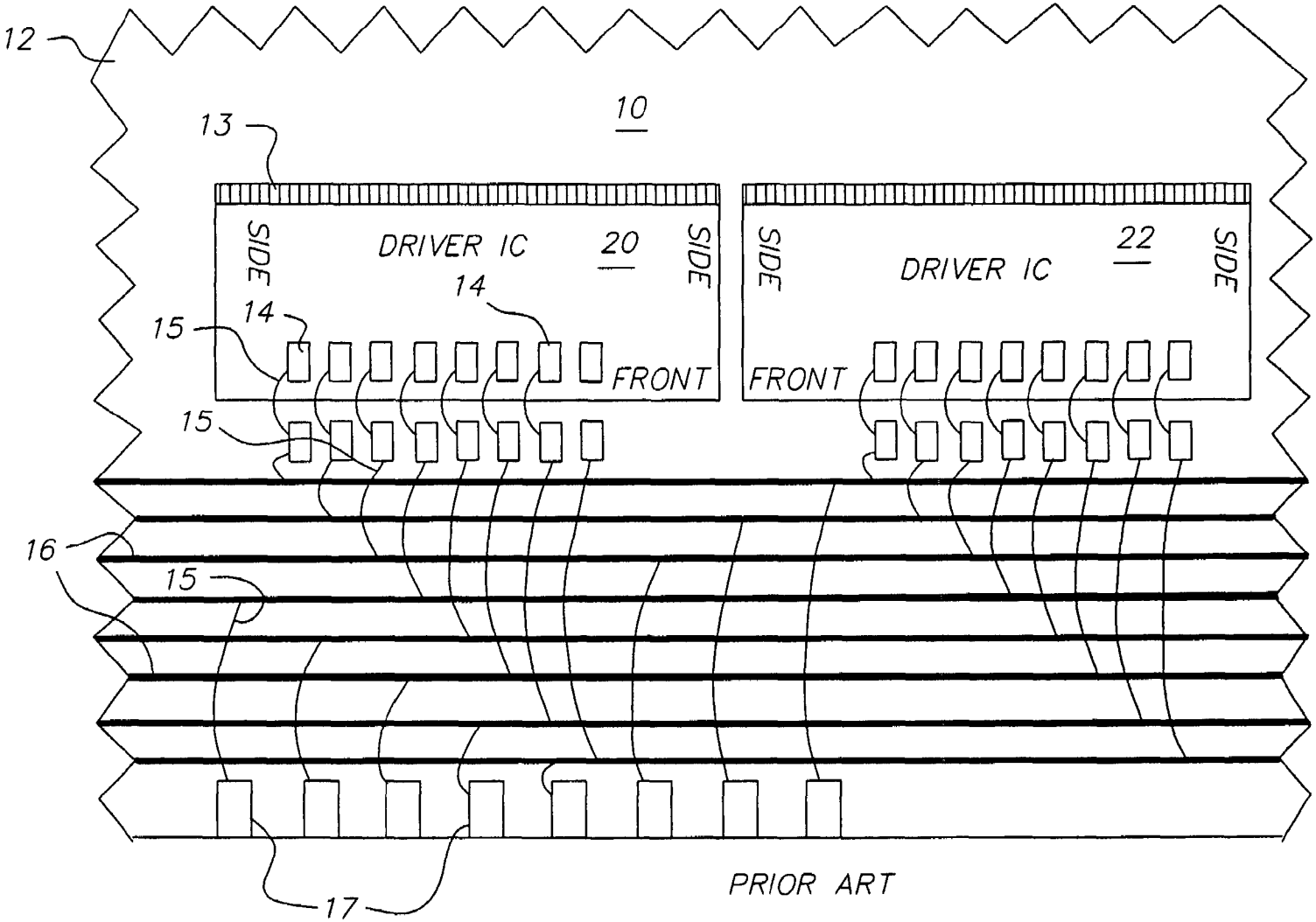
FIG. 1 is a block diagram of a prior art printhead driver IC board that is used to control LEDs in a digital printer.
Figure 2:
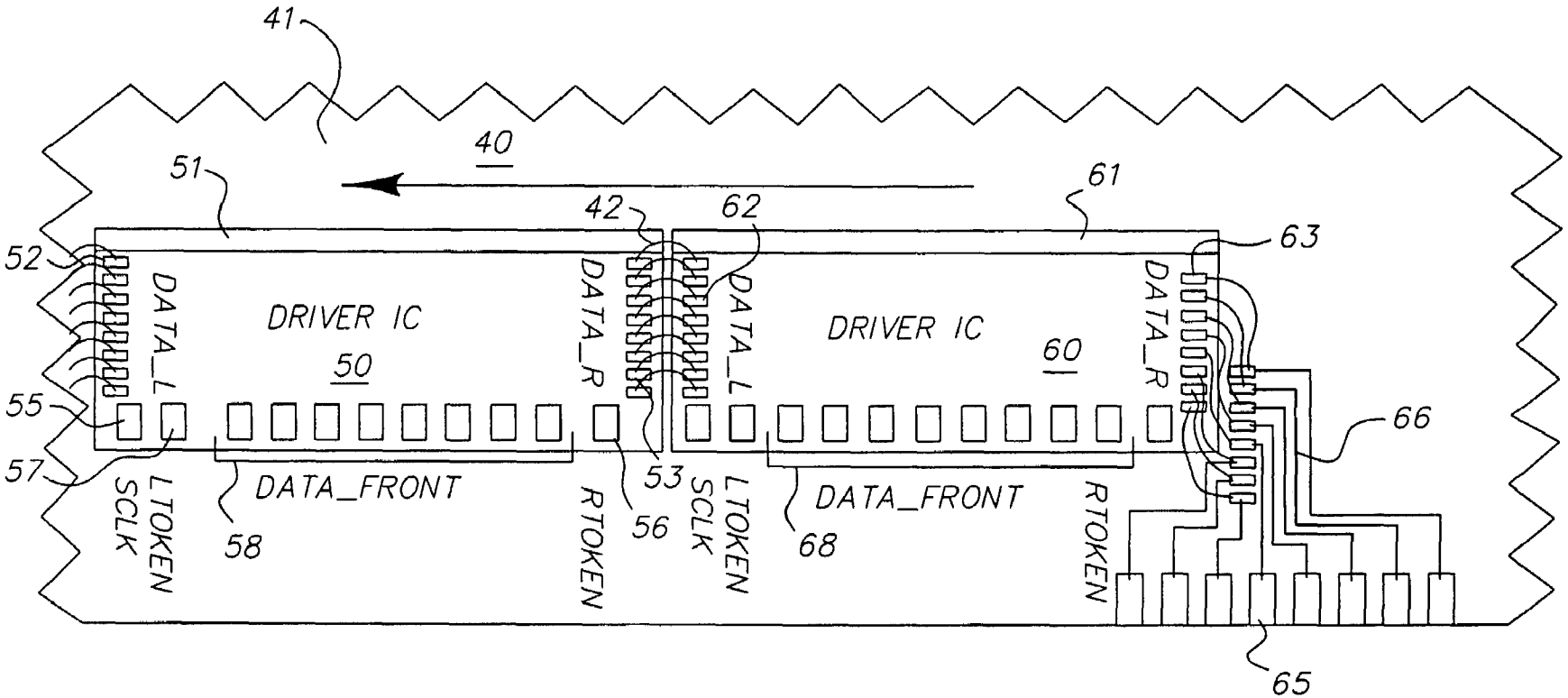
FIG. 2 is a block diagram of a printhead driver IC board that is used to control LEDs in a digital printer in accordance with one embodiment of the present invention.

FIG. 2 is a block diagram of a printhead driver IC board 40 that is used to control LEDs in a digital printer in accordance with one embodiment of the present invention. Board 40 includes driver ICs 50 and 60 mounted on a substrate 41. In one embodiment, driver ICs 50, 60, like driver ICs 20, 22 of FIG. 1, include input pads along the long sides for coupling to LEDs (data pads 51, 61) and for coupling to a data bus on the front side (data pads 58, 68). Driver ICs 50, 60 are two drivers within a string of many driver ICs on board 40. Driver ICs 50, 60 further include data pads or pins 52, 53, 62, 63 on each short side of the ICs. These side data pads can input or output data from the sides of ICs 50, 60. Wire bonds 42 between each driver IC 50, 60 allows data to be passed from IC to IC. Host data bus board connections 65 are coupled to the first driver IC 60 in the string of driver ICs by traces 66. In one embodiment, the driver IC at the beginning left side of the driver IC string of board 40 will also be coupled to the host data bus by traces. In this embodiment, data can be initiated at the left side of the driver IC string and transmitted left to right, or vice versa.

In one embodiment, each driver IC on board 40 is coupled to 96 LEDs, and each driver IC is approximately ⅓ inch long. Therefore, in most embodiments board 40 will include many driver ICs to form the entire width of the printhead.

In one embodiment, each driver IC on board 40 includes logic circuitry for selecting whether host data will be transmitted on the front or on the sides, as well as whether the data will flow from left to right, or from right to left. Driver ICs 50, 60, includes an input pad for a right token selection (pad 56) and a left token selection (pad 55). Driver ICs further include an input pad for an SCLK clock input (pad 57).

Token selection is used for token control, which is direction control of data loading inside driver ICs 50, 60. Data for multiple exposure elements is passed from right to left or left to right in a serial fashion so that multiple exposure element registers can be loaded by one external data path. The token shifts by one element on every SCLK transition.

Figure 3:
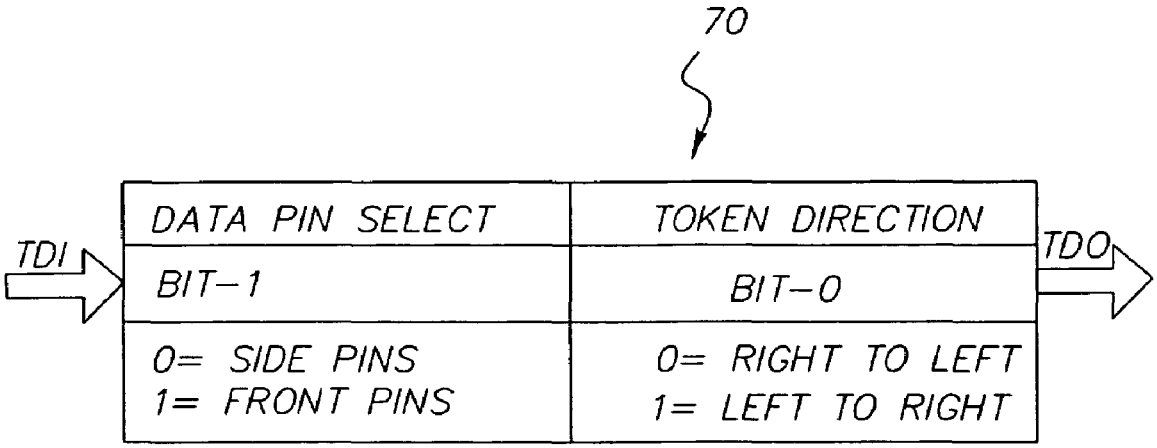
FIG. 3 is a block diagram of a control register in accordance with one embodiment of the present invention to provide software control of the front pin vs. side pin selection and direction of data loading flow.

FIG. 3 is a block diagram of a control register 70 in accordance with one embodiment of the present invention to provide software control of the front pin vs. side pin selection and direction of data loading flow. In the embodiment shown in FIG. 3, register 70 is a Joint Test Action Group ("JTAG") compatible serial register in accordance with the IEEE 1149.1 boundary scan standard. Register 70 includes a "TDI" input and a "TDO" output.

Bit-0 controls the data flow direction. When set to zero the loading data flows from the right end of the driver IC to the left end. When set to one the loading data flows from the left end of the IC to the right end.

Bit-1 selects the input data source pins. When bit-1 is set to zero the side pins become the input data source. If bit-0 is zero then the right side pins become the input data path ("DataRight") and the data exits out the left side pins ("DataLeft"). If bit-0 is one then the left side pins become the input data path ("DataLeft") and the data exits out the right side pins ("DataRight"). When bit-1 set to one the front pins become the input data source. If bit-0 is zero then the front pins become the input data path ("DataFront") and the data exits out the left side pins ("DataLeft"). If bit-0 is one then the front pins become the input data path and the data exits out the right side pins ("DataRight").

The table below summarizes the functionality of control register 70.

| Bit Position | Function |
|---|---|
| 0 | Token and Data Direction (0 = Right to Left, 1 = Left to Right) |
| 1 | Front Data Input Enable (0 = Side data pins enabled, 1 = Front data pins enabled) |

Figure 4:
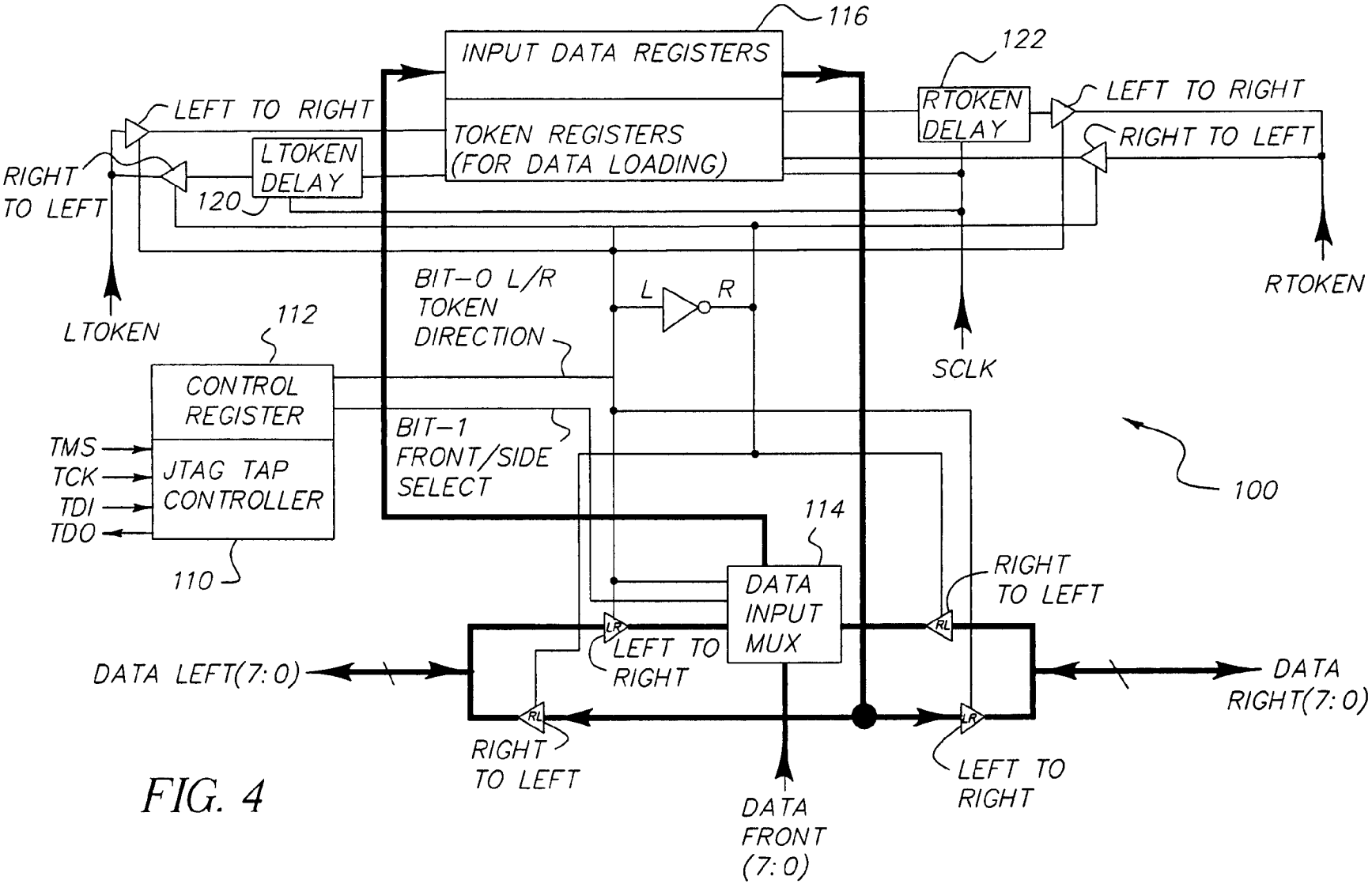
FIG. 4 is a circuit diagram of logic circuitry of driver ICs that provides the data pin and direction selection in accordance with one embodiment of the present invention.

FIG. 4 is a circuit diagram of logic circuitry of driver ICs 50, 60 that provides the data pin and direction selection in accordance with one embodiment of the present invention. Circuitry 100 includes a JTAG TAP controller 110, which can be a standard JTAG compliant controller used for accessing JTAG registers. A Control register 112 can be implemented as a standard JTAG register and selects the input data pins source and direction of token flow. An input data multiplexor 114 steers the appropriate input data source to input data registers 116.

The input data source can be any of three sources: side data ("DataLeft" or "DataRight"), or "DataFront" selected by bits 0 and 1 of Control register 112. Output data is either "DataLeft" or "DataRight" dictated by bit-0 of Control register 112. Token control is cascaded from the first data latch register to the last data latch register for each element within the driver ICs.

Token control is passed from the IC TOKEN output pad of the previous driver IC to the IC TOKEN input pad of the next driver IC connected to the chain. LTOKEN and RTOKEN are also bi-directional with input/output dictated by the direction bit. When bit-0 is zero, RTOKEN is the input token and LTOKEN is the output token pin. When bit-0 is one the reverse is true. RTOKEN DELAY 122 and LTOKEN DELAY 120 are flip-flops that keep the DATA and SCLK inputs in synchronization up through the exit points of the IC.

As described, embodiments of the present invention have a dual input selection (either front input or one of the sides input) that provides flexibility so that the driver IC to be used for a broader number of applications. The use of side data bussing to the driver IC allows for more efficient connection of multiple drivers and also helps accomplish increased speed demand with lower EMI emissions. As shown in FIG. 2, the side driver IC pins implementation results in a reduction of wire bonds. The data is passed from IC to IC with one wire bond connection per signal.

In addition, embodiments of the present invention result in reduced loading on the host-driving component. Only the first driver needs to be driven directly by the host data path system. Each data bus connection from the host interface pads to the first IC are of similar length, as well as each connection set from IC to IC. This vastly improves the achievable data speeds and eliminates the stub like multiple connections shown in the prior art in FIG. 1.

In addition, embodiments of the present invention greatly increase data flow options. Breaking down the substrate into multiple sections helps achieve faster data rates. Data can enter sections of the driver ICs from front pads or side pads or any combination that maximizes the efficiency of the physical layout. The multiple input source flexibility allows for better ease of sectioning the substrate while at the same time using methods of data bussing that lower EMI emissions.

The side-to-side pin data flow in embodiments of the present invention produces several advantages over the front pin architecture. Loading and current requirements of the host board data-driving components is greatly reduced. One load per bit is driven versus multiple loads, which reduces the current required to drive the transmission lines. EMI is greatly reduced due to single load connection, shorter signal paths and with much closer matched signal lengths. Signal paths are point-to-point connection instead of parallel busses with multiple stub-like connections.

In addition, with embodiments of the present invention reliability is improved and cost of manufacturing is reduced due to reduction of point-to-point connections required. Using side to side bussing vs. front connection can attain at least a 50% reduction of connections.

Further, in embodiments where the side pins are bi-directional and a selection of direction is made by use of a software accessible control bit, the driver IC can be used on a two-sided substrate where each side has an opposite direction of data flow. Further, more flexibility of data connection can be accomplished in embodiments of the present invention by also implementing the front pins. By allowing selection of front data inputs or side data inputs by use of a software accessible control bit, the driver IC can be used for many applications. Because data can be driven from the driver IC paths through the front or side pins, one driver IC can be compatible with multiple print head designs. The dual pin selection can be used for any combination of location inputs and could easily be expanded to more than two selections.

Several embodiments of the present invention are specifically illustrated and/or described herein. However, it will be appreciated that modifications and variations of the present invention are covered by the above teachings and within the purview of the appended claims without departing from the spirit and intended scope of the invention.

What is claimed is:

1. A driver integrated circuit (IC) for a printhead, said driver IC comprising:

a first set of data input/output pads;

a second set of data input/output pads; and circuitry adapted to select that data is to be input at said first set of pads and output at said second set of pads.

2. The driver IC of claim 1, wherein said circuitry is adapted to further select that data is to be input at said second set of pads and output at said first set of pads.

3. The driver IC of claim 1, further comprising:

a first and second short side;

a first and second long side; and wherein said first set of pads are positioned on said first short side and said second set of pads are positioned on said second short side.

4. The driver IC of claim 3, further comprising:

a third set of pads positioned on said first long side.

5. The driver IC of claim 4, wherein said circuitry is adapted to further select that data will be input at said third set of pads.

6. The driver IC of claim 4, further comprising a fourth set of pads positioned on said second long side for coupling the driver IC to exposure elements.

7. The driver IC of claim 6, wherein the exposure elements are light emitting diodes.

8. The driver IC of claim 1, wherein said circuitry comprises a Joint Test Action Group (JTAG) controller and a JTAG control register.

9. The driver IC of claim 8, further comprising a token input pad, a token output pad, and a clock input pin.

10. A method of processing printing data by a driver integrated circuit (IC) for a printhead, said method comprising:

receiving input bits;

based on the input bits, determining whether data will be input at first data pads on a short side of the driver IC or at second data pads on a long side of the driver IC; and based on the input bits, determining whether the data will be transmitted from left to right on the driver IC, or from right to left on the driver IC.

11. The method of claim 10, wherein the input bits are received by a Joint Test Action Group (JTAG) controller.

12. A driver integrated circuit (IC) board for a printhead comprising:

host data bus connections;

a first driver IC having first short side pads coupled to said host data bus connections and having second short side pads; and a second driver IC having third short side pads coupled to said second short side pads.

13. The driver IC board of claim 12, wherein said first driver IC comprises circuitry which selects a direction of data flow between said first short side pads and said second short side pads.

14. The driver IC board of claim 13, wherein said circuitry comprises a Joint Test Action Group (JTAG) controller and a JTAG control register.

15. The driver IC board of claim 12, said first driver IC further comprising first long side pads.

16. The driver IC board of claim 15, wherein said circuitry further selects that data will be input at said first short side pads or said first long side pads.

17. The driver IC board of claim 15, further comprising second long side pads for coupling the first driver IC to exposure elements.

18. The driver IC board of claim 15, wherein the exposure elements are light emitting diodes.

19. The driver IC board of claim 12, further comprising a substrate.

* * * * *

UNITED STATES PATENT AND TRADEMARK OFFICE

CERTIFICATE OF CORRECTION

PATENT NO. : 7,246,887 B2
APPLICATION NO. : 11/013143
DATED : July 24, 2007
INVENTOR(S) : Shawn E. O'Hara et al.

It is certified that error appears in the above-identified patent and that said Letters Patent is hereby corrected as shown below:

Claim 18, Column 6, Line 34, delete "claim 15," and insert -- claim 17, --.

Signed and Sealed this

Sixth Day of November, 2007

JON W. DUDAS
*Director of the United States Patent and Trademark Office*